US006321733B1

(12) United States Patent
Suckewer et al.

(10) Patent No.: US 6,321,733 B1
(45) Date of Patent: Nov. 27, 2001

(54) TRAVELING SPARK IGNITION SYSTEM AND IGNITOR THEREFOR

(75) Inventors: Szymon Suckewer; Enoch J. Durbin, both of Princenton, NJ (US)

(73) Assignee: Knite, Inc., Princeton, NJ (US)

( * ) Notice: Subject to any disclaimer, the term of this patent is extended or adjusted under 35 U.S.C. 154(b) by 0 days.

(21) Appl. No.: 09/194,167

(22) PCT Filed: May 29, 1997

(86) PCT No.: PCT/US97/09240

§ 371 Date: Mar. 8, 1999

§ 102(e) Date: Mar. 8, 1999

(87) PCT Pub. No.: WO97/45636

PCT Pub. Date: Dec. 4, 1997

Related U.S. Application Data

(60) Provisional application No. 60/018,534, filed on May 29, 1996.

(51) Int. Cl.[7] ..... F02P 15/10
(52) U.S. Cl. ..... 123/620; 123/143 B
(58) Field of Search ..... 123/620, 143 B

(56) References Cited

U.S. PATENT DOCUMENTS 4,041,922 * 8/1977 Abe et al. ..... 123/143 B
4,493,297 * 1/1985 McIlwain et al. ..... 123/143 B
4,774,914 * 10/1988 Ward ..... 123/620
4,841,925 * 6/1989 Ward ..... 123/620
5,076,223 * 12/1991 Harden et al. ..... 123/143 B
5,211,142 * 5/1993 Matthews et al. ..... 123/143 B
5,513,605 * 5/1996 Weldon ..... 123/143 B
5,619,959 * 4/1997 Tuzzi ..... 123/143 B
5,704,321 * 1/1998 Suckewer et al. ..... 123/143 B

* cited by examiner

*Primary Examiner*—Erick Solis
(74) *Attorney, Agent, or Firm*—Wolf, Greenfield & Sacks, P.C.

(57) ABSTRACT

A plasma ignitor, or plasma source, for igniting a combustible mixture in an internal combustion engine. The ignitor includes at least two spaced apart electrodes dimensioned and arranged such that an outwardly moving plasma is formed when a voltage is applied across the electrodes. The present invention is characterized by its efficient use of input electrical energy for driving the plasma ignitor and by an ignition plasma kernel which is several orders of magnitude larger than that produced by conventional spark plugs. Outward motion and expansion of the plasma kernel is produced by a combination of Lorentz and thermal forces. Use of very lean combustible mixtures, in which the dilution of the mixture is achieved by use of exhaust gas recirculation, is made possible by the present ignition system. Improvement in engine efficiency, and a major reduction in exhaust gas pollutants are obtained.

117 Claims, 7 Drawing Sheets

TRAVELING SPARK IGNITION SYSTEM AND IGNITOR THEREFOR

This Application is a 371 of PCT/US97/09240 filed May 29, 1997 and also claim the benefit of Provisional No. 60/018,534 filed May 29, 1996.

FIELD OF THE INVENTION

This invention relates generally to internal combustion engine ignition systems, including the associated firing circuitry and ignitors such as spark plugs.

BACKGROUND OF THE INVENTION

Automobiles have undergone many changes since their initial development at the end of the last century. Many of these evolutionary changes can be seen as a maturing of technology, with the fundamental principles remaining the same. Such is the case with the ignition system. Some of its developments include the replacement of mechanical distributors by electronic ones, increasing reliability and allowing for easy adjustment of the spark timing under different engine operating conditions. The electronics responsible for creating the high voltage required for the discharge have changed, with transistorized coil ignition (TCI) and capacitive discharge ignition (CDI) systems common today. However, the basic spark plug structure has not changed. Spark plugs today differ from earlier ones mostly in the use of improved materials, but the basic point-to-point discharge remains the same.

A spark driven by the force from the interaction of the magnetic field created by the spark current and the current itself is very attractive concept, for enlarging the ignition kernel for a given ignition system input energy.

The need for an enhanced ignition source has long been recognized. Many inventions have been made which provide enlarged ignition kernels. The use of plasma jets and Lorentz force plasma accelerators have been the subject of much study and patents. None of these prior inventions have resulted in practical commercially acceptable solutions, though. The primary weakness of the prior inventions has been the requirement for excessive ignition energy, which eliminates any possible efficiency enhancement in the engine in which they are employed. These higher ignition energy requirements have resulted in high rates of ignition electrode erosion, which reduces ignition operating life to unacceptable levels.

The concept of enlarging the volume and surface area of the spark initiated plasma ignition kernel is an attractive idea for extending the practical lean limit for combustible mixtures in a combustion engine. The objective is to reduce the variance in combustion delay which is typical when engines are operated with lean mixtures. More specifically, there has been a long felt need to eliminate ignition delay, by increasing the spark volume. While it will be explained in more detail below, note that if a plasma is confined to the small volume between the discharge electrodes (as is the case with a conventional spark plug), its initial volume is quite small, typically about 1 $mm^3$ of plasma having a temperature of 60,000° K. is formed. This kernel expands and cools to a volume of about 25 $mm^3$ and a temperature of 2,500° K., which can ignite the combustible mixture. This volume represents about 0.04% of the mixture that is to be burned to complete combustion in a 0.5 liter cylinder at a compression ratio of 8:1. From the discussion below it will be seen that, if the ignition kernel could be increased 100 times, 4% of the combustible mixture would be ignited and the ignition delay would be significantly reduced. This attractive ignition goal has not heretofore been achieved in practical systems, though.

The electrical energy required in these earlier systems, e.g., Fitzgerald et al., U.S. Pat. No. 4,122,816, is claimed to be more than 2 Joules per firing (col. 2, lines 55–63). This energy is about 40 times higher than that used in conventional spark plugs.

Matthews et al., infra, reports the use of 5.5 Joules of electrical energy per ignition, or more than 100 times the energy used in conventional ignition systems.

Consider a six cylinder engine operating at 3600 RPM, which requires firing three cylinders every engine revolution or 180 firings per second. At 2 Joules per firing this is 360 Joules/second. This energy must be provided by the combustion engine at a typical efficiency of about 18% and converted to a suitable higher voltage by power conversion devices with a typical efficiency of about 40%, for a net use of the engine fuel at an efficiency of about 7.2%. Fitzgerald requires a fuel consumption of 360/0.072 Joules/second, or about 5000 Joules/second to run the ignition system.

To move a 1250 kg vehicle on a level road at about 80 km/hr (about 50 mph) requires about 9000 Joules/second of fuel energy. At an engine fuel to motive force conversion efficiency of 18%, about 50,000 Joules/second of energy will be consumed. Thus, the system employed by Fitzgerald et al, infra, will consume about 10% of the fuel energy consumed to run the vehicle to run the ignition system. This is greater than the efficiency gain to be expected by use of the Fitzgerald et al. ignition systems.

By comparison, conventional ignition systems use about 0.25 percent of the fuel energy to run the ignition system. Further, the high energy employed in these systems causes high levels of erosion to occur in the electrodes of the spark plugs, thus reducing the useful operating life considerably. This shortened life is demonstrated in the work by Matthews et al., infra, where the need to reduce ignition energy is acknowledged although no solution is provided.

As an additional attempt at solving this problem, consider the work by Tsao and Durbin (Tsao, L. and Durbin, E. J., "Evaluation of Cyclic Variation and Lean Operation in a Combustion Engine with a Multi-Electrode Spark Ignition System", *Princeton Univ., MAE Report,* (January, 1984)), where a larger than regular ignition kernel was generated by a multiple electrode spark plug, demonstrating a reduction in cyclic variability of combustion, a reduction in spark advance, and an increase in output power. The increase in kernel size was only six times that of an ordinary spark plug.

Bradley and Critchley (Bradley, D., Critchley, I. L., "Electromagnetically Induced Motion of Spark Ignition Kernels", *Combust. Flame* 22, pgs. 143–152 (1974)) were the first to consider the use of electromagnetic forces to induce a motion of the spark, with an ignition energy of 12 Joules. Fitzgerald (Fitzgerald, D. J., "Pulsed Plasma Ignitor for Internal Combustion Engines", *SAE paper* 760764 (1976); and Fitzgerald, D. J., Breshears, R. R., "Plasma Ignitor for Internal Combustion Engine", U.S. Pat. No. 4,122,816 (1978)) proposed to use pulsed plasma thrusters for the ignition of automotive engines with much less but still substantial ignition energy (approximately 1.6 J). Although he was able to extend the lean limit, the overall performance of such plasma thrusters used for ignition systems was not significantly better than that of regular spark plugs and the sparks they produce. In this system, much more ignition energy was used without a significant increase in plasma kernel size. (Clements, R. M., Smy, P. R., Dale. J. D., "An Experimental Study of the Ejection Mechanism for Typical Plasma Jet Ignitors", *Combust. Flame* 42, pages 287–295 (1981)). More recently Hall et al. (Hall, M. J., Tajima, H., Matthews, R. D., Koeroghlian, M. M., Weldon, W. F., Nichols, S. P., "Initial Studies of a New Type of Ignitor: The Railplug", *SAE paper* 912319 (1991)), and Matthews et al. (Matthews, R. D., Hall, as M. J., Faidley, R. W., Chiu, J. P., Zhao, X. W., Annezer, I., Koening, M. H., Harber, J. F., Darden, M. H., Weldon, W. F., Nichols, S. P., "Further Analysis of Railplugs as a New Type of Ignitor", *SAE paper* 922167 (1992)), have shown that a "rail plug" operated at an energy of over 6 J (2.4 cm long) showed a very substantial improvement in combustion bomb experiments. They also observed improvements in the lean operation of an engine when they ran it with their spark plug at an ignition energy of 5.5 J. They attributed the need of this excessive amount of energy to poor matching between the electrical circuit and the spark plug. This level of energy expended in the spark plug is about 25% of the energy consumed in propelling a 1250 kg vehicle at 80 km/hr on a level road. Any efficiency benefits in engine performance would be more than consumed by the increased energy in the ignition system.

SUMMARY OF THE INVENTION

A first significant aspect of the invention is a plasma injector, or ignitor, for an internal combustion engine, including at least first and second electrodes; means for maintaining the electrodes in a predetermined, spaced-apart relationship; and means for mounting in an internal combustion engine with active portions of the electrodes installed in a combustion cylinder of the engine. The electrodes are dimensioned and configured, and their spacing is arranged, such that when a sufficiently high voltage is applied across the electrodes while the ignitor is installed in an internal combustion engine, in the midst of a gaseous mixture of air and fuel, a plasma is In formed in the mixture between the electrodes and the plasma moves outwardly from between the electrodes into an expanding volume in the cylinder, under a Lorentz force. The spaced relationship between the electrodes may be maintained by surrounding a substantial portion of the electrodes with a dielectric material such that as the voltage is applied to the electrodes, the plasma forms on or in the vicinity of the surface of the dielectric. The voltage may be reduced, and increased current supplied, to maintain the plasma after its initial formation.

As more particularly explained herein, another aspect of the invention is a plasma injector, or ignitor, for an internal combustion engine, one embodiment of which includes two electrodes which are spaced apart and have substantially parallel and circular facing surfaces between which a radially outwardly moving plasma is formed in the fuel-air mixture via a voltage applied across the electrodes.

According to another aspect of the invention, a plasma injector, or ignitor, for an internal combustion engine includes at least two spaced apart and substantially parallel longitudinal electrodes, between which a longitudinally outwardly-moving plasma is formed via a high voltage applied across the electrodes.

Another aspect of the invention, usable with the two preceding aspects of the invention, is an ignition source which provides an ignition plasma kernel by providing a sufficiently high first voltage for creating a channel formed of plasma between the electrodes and a second voltage of lower potential than the first voltage for sustaining current through the plasma in the channel between the electrodes, such that said current and a magnetic field resulting from a current in at least one of the electrodes arising from the current in the plasma interact to create a Lorentz force upon the plasma that, in combination with thermal expansion forces, causes the plasma to move away from its region of origin and to expand in volume.

According to yet another aspect, the invention comprises an ignitor which includes substantially parallel and spaced apart electrodes, including at least first and second electrodes forming a discharge gap between them, wherein the ratio of the sum of the radii of the electrodes to the length of the electrodes is larger than or equal to about four, while the ratio of the difference of these two radii to the length of the electrodes is larger than about one-third; a dielectric material surrounds a substantial portion of the electrodes and the space between them; an uninsulated end of portion of each of the electrodes is free of said dielectric material and in oppositional relationship to one another; and wherein there are means for mounting the ignitor with the free ends of the first and second electrodes installed in a combustion cylinder of a combustion engine.

According to still another aspect of the invention, an ignitor is provided which includes at least two parallel and spaced apart electrodes adapted for forming discharge gaps between them, wherein the radius of the largest cylinder which can fit between the electrodes is greater than the length of an electrode divided by six; a dielectric material surrounds a substantial portion of the electrodes and the space between them; an uninsulated end portion of each of the electrodes is free of the dielectric material and in oppositional relationship to one another, the uninsulated end portions being designated the lengths of the electrodes, and further including means for mounting the ignitor with free ends of the electrodes in a combustion cylinder of an engine.

A still further aspect of the invention is a traveling spark ignition system for a combustion engine which includes an ignitor and together therewith or separately therefrom electrical means for providing a potential difference between electrodes of the ignitor. The ignitor includes substantially parallel and spaced apart coaxial electrodes which include a least first and second electrodes forming a discharge gap between them, wherein the ratio of the sum of the radii of the electrodes to their lengths is larger than or equal to about four, while the ratio of the difference of these two radii to the lengths of the electrodes is larger than about one-third. A dielectric material, such as a polarizable ceramic, surrounds a substantial portion of the electrodes and the space between them, with an uninsulated end portion of each of the electrodes being free of the dielectric material and in oppositional relationship to one another. Means are included for mounting the ignitor with the free ends of the electrodes installed in a combustion cylinder of an engine. Such means may include threads on one of the electrodes. The electrical means for providing a potential difference between the electrodes initially provides a sufficiently high first voltage for creating a channel formed of plasma in the fuel-air mixture between the electrodes, and thereafter provides a second voltage of lower potential than the first voltage for sustaining a current through the plasma in the channel between the electrodes. As a result, said current in at least one of the electrodes interacts with a magnetic field in a manner which creates a Lorentz force upon the plasma, causing it to move away from its region of origin.

According to a further aspect of the invention, there is provided a traveling spark ignition system for a combustion engine which includes an ignitor and electrical means for sequentially providing two potential differences between electrodes of the ignitor. The ignitor includes at least two parallel spaced apart electrodes adapted to form discharge gaps between them, wherein the radius of the largest cylinder which can fit between said electrodes is greater than the length of the electrodes; a dielectric material surrounds a substantial portion of the electrodes and a space between them, which dielectric material may, for example, be a polarizable ceramic material; an uninsulated end portion of each of the electrodes is free of the dielectric material and in oppositional relationship to one another, the uninsulated end portions being the aforesaid lengths of the electrodes; and means being provided for mounting the ignitor with the free ends of the electrodes in a combustion cylinder of an engine, such means being, for example, threads provided on one of the electrodes. The electrical means for sequentially providing potential differences between the electrodes provides a first potential difference which is sufficiently high to create a channel formed of plasma between the electrodes, after which the potential difference is reduced to a second voltage of lower potential than the first voltage for sustaining a current through the plasma in the channel between the electrodes. Said current interacts with a magnetic field arising from a current in a manner which creates a force upon the plasma to cause it to move away from its region of origin, to increase the swept volume of the plasma.

BRIEF DESCRIPTION OF THE DRAWINGS

Various embodiments of the invention are illustrated and described below with reference to the accompanying drawings, in which like items are identified by the same reference designation, wherein.

DETAILED DESCRIPTION OF THE INVENTION

Figure 2:
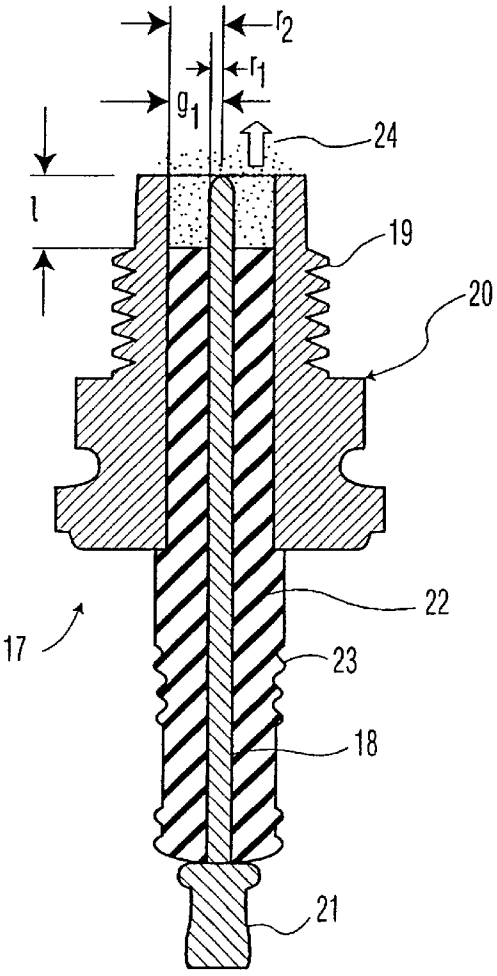
FIG. 2 is a cross-sectional view of a cylindrical traveling spark ignitor for one embodiment of this invention, taken through the axes of the cylinder, including two electrodes and wherein the plasma produced travels by expanding in the axial direction.

The invention is a traveling spark initiator or ignitor (TSI) in the form of a miniature Marshall gun (coaxial gun), with high efficiency of transfer of electric energy into plasma volume creation. In the embodiment of FIG. 2, a ratio of a sum of the radii ($r_2$) and ($r_1$), of an external electrode and internal electrode, respectively, to the length (l) of the electrodes should be larger than or equal to 4, whereas the ratio of the difference of these two radii ($r_2-r_1$)=$g_1$ to the length (l) of the electrodes should be larger than ⅓ (preferably larger than ½), as follows:

$$\frac{r_2+r_1}{l} \geq 4 \quad \text{and} \quad \frac{r_2-r_1}{l} > \frac{1}{3}$$

and $g_1$ is the gap spacing between the electrodes.

Figure 3:
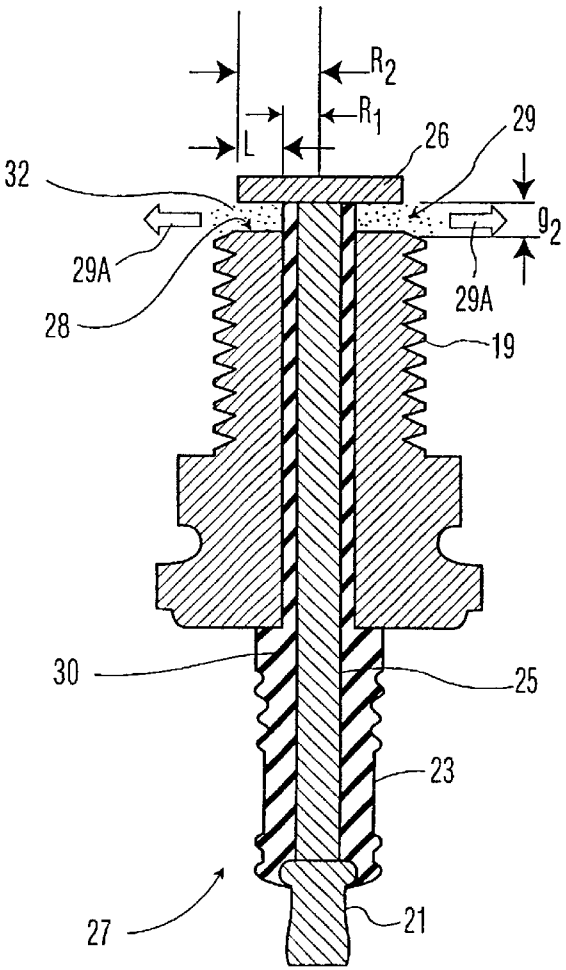
FIG. 3 is a similar cross-sectional view of a traveling spark ignitor for another embodiment of the invention wherein the plasma produced travels by expanding in the radial direction.

Similar relations are required for the embodiment of FIG. 3, where $r_2$ and $r_1$ from FIG. 2 are replaced by $R_2$ and $R_1$ as shown, the gap between the electrodes is $g_2$, and the length of the electrodes is L. Hence $$\frac{R_2+R_1}{L} \geq 4 \quad \text{and} \quad \frac{g_2}{L} > \frac{1}{3}$$

The heat transfer to the combustible mixture occurs in the form of the diffusion of ions and radicals from the plasma. The very large increase in plasma volume dramatically increases the rate of heat transfer to the combustible mixture.

The principle of the Marshall gun is discussed first. There follows a discussion of the environmental benefits provided by larger spark volumes. The construction details of such a system will then be discussed relative to various embodiments of the invention.

Figure 1:
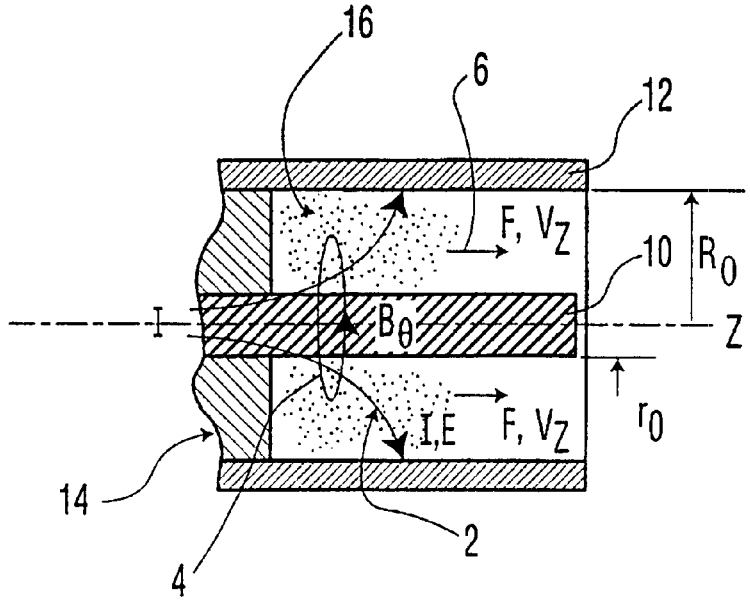
FIG. 1 is a cross-sectional view of a cylindrical Marshall gun with a pictorial illustration of its operation, which is useful in understanding the invention.

The principle of the Marshall gun presents an effective way of creating a large volume of plasma. The schematic presentation in FIG. 1 shows the electric field 2 and magnetic field 4 in an illustrative coaxial plasma gun, where $B_\theta$ is the poloidal magnetic field directed along field line 4. The plasma 16 is moved in a direction 6 by the action of the Lorentz force vector F and thermal expansion, with new plasma being continually created by the breakdown of fresh gas as the discharge continues. $V_Z$ is the plasma kernel speed vector, also directed in the z-direction represented by arrow 6. Thus, the plasma 16 grows as it moves along and through the spaces between electrodes 10, 12 (which are maintained in a spaced relationship by isolator or dielectric 14). Once the plasma 16 leaves the electrodes 10, 12, it expands in volume, cooling in the process. It ignites the combustibles mixture after it has cooled to the ignition temperature.

Fortunately, increasing plasma volume is consistent with acknowledged strategies for reducing emissions and improving fuel economy. Two such strategies are to increase the dilution of the gas mixture inside the cylinder and to reduce the cycle-to-cycle variations.

Dilution of the gas mixture, which is most commonly achieved by the use of either excess air (running the engine lean) or exhaust gas recirculation (EGR), reduces the formation of oxides of nitrogen by lowering the combustion temperature. Oxides of nitrogen play a critical role in the formation of smog, and their reduction is one of the continuing challenges for the automotive industry. Dilution of the gas mixture also increases the fuel efficiency by lowering temperature and thus reducing the heat loss, through the combustion chamber walls, improving the ratio of specific heats, and by lowering the pumping losses at a partial load.

Zeilinger determined the nitrogen oxide formation per horsepower-hour of work done, as a function of the air to fuel ratio, for three different spark timings (Zeilinger, K., Ph.D. thesis, Technical University of Munich (1974)). He found that both the air-to-fuel ratio and the spark timing affect the combustion temperature, and thus the nitrogen oxide formation. As the combustible mixture or air/fuel ratio (A/F) is diluted with excess air (i.e., A/F larger than stoichiometric), the temperature drops. At first, this effect is diminished by the increase in the amount of oxygen. The $NO_x$ formation increases. When the mixture is further diluted, the $NO_x$ formation decreases to values much below those at a stoichiometric mixture because the combustion temperature decline overwhelms the increase in $O_2$.

A more advanced spark timing (i.e., initiating ignition more degrees before top dead center) raises the peak temperature and decreases engine efficiency because a larger fraction of the combustible mixture burns before the piston reaches top dead center (TDC) and the mixture is compressed to a higher temperature, hence leading to much higher $NO_x$ levels and heat losses. As the mixture is made lean, the spark timing which gives the maximum brake torque (MBT timing) increases.

Dilution of the mixture results in a reduction of the energy density and the flame propagation speed, which affect ignition and combustion. The lower energy density reduces the heat released from the chemical reaction within a given volume, and thus shifts the balance between the chemical heat release and the heat lost to the surrounding gas. If the heat release is less than that lost, the flame will not propagate. An increase in the ignition volume is required to assure that the flame propagation does not slow down as the energy density of the combustible mixture is reduced.

Reducing the flame propagation speed increases the combustion duration. Ignition delay results from the fact that the flame front is very small in the beginning, which causes it to grow very slowly, as the quantity of fuel-air mixture ignited is proportional to the surface area. The increase in the ignition delay and the combustion duration results in an increase of the spark advance required for achieving the maximum torque, and reduces the amount of output work available. A larger ignition kernel will reduce the advance in spark timing required, and thus lessen the adverse effects associated with such an advance. (These adverse effects are an increased difficulty to ignite the combustible mixture, due to the lower density and temperature at the time of the spark, and an increase in the variation of the ignition delay, which causes driveability to deteriorate).

Cyclic variations are caused by unavoidable variations in the local air-to-fuel ratio, temperature, amount of residual gas, and turbulence. The effect of these variations on the cylinder pressure is due largely to their impact on the initial expansion velocity of the flame. This impact can be significantly reduced by providing a spark volume which is appreciably larger than the mean sizes of the inhomogeneities.

A decrease in the cyclic variations of the engine conditions will reduce emissions and increase efficiency, by reducing the number of poor bum cycles, and by extending the operating air fuel ratio range of the engine.

Quader determined the mass fraction of the combustible mixture which was burned as a function of the crank angle, for two different start timings (Quader. A., "What Limits Lean Operation in Spark Ignition Engines—Flame Initiation or Propagation?", *SAE Paper* 760760 (1976)). His engine was running very lean (i.e., an equivalence ratio of about 0.7), at 1200 rpm and at 60% throttle. The mass fraction burned did not change in any noticeable way immediately after the spark occurred (there is an interval where hardly any burning can be detected, commonly known as the ignition delay). This is due to the very small volume of the spark, and the slow combustion duration due to the small surface area and relatively low temperature. Once a small percentage of the combustible mixture has burned, the combustion rate increases, slowly at first, and then more rapidly as the flame front grows. The performance of the engine at both of these spark timings is poor. In the case of 60° B.T.D.C. (before top dead center ignition timing), too much of the mixture has burned while the piston is compressing the mixture therefore, negative work is being done. The rise in pressure opposes the compression strokes of the engine. In the case of 40° B.T.D.C. timing, a considerable fraction of the mixture is burned after the expansion strokes have started, thus reducing the output work available.

The intersection of a 4% burned line with the curves determined by Quader, Id., shows the potential advantage that a large spark volume, if it were available, would have in eliminating the ignition delay. For the 60° B.T.D.C. spark curve, if the spark timing is changed from 60° to 22° B.T.D.C., a change of nearly 40 degrees, the rate of change of mass fraction burned will be higher because the combustible mixture density will be higher at the moment of ignition. For the 40° B.T.D.C. spark time curve, if the timing is changed from 40° to 14° B.T.D.C., a change of about 25 degrees, the combustible mixture will be completely burned at a point closer to TDC, thus increasing efficiency.

The above arguments clearly illustrate the importance of an increase in spark volume for reduced emission and improved fuel economy. With the TSI system of the present invention, the required spark advance for maximum efficiency can be reduced by 20° to 30°, or more.

While increasing spark volume, the TSI system also provides for moving the spark deeper into the combustible mixture, with the effect of reducing the combustion duration.

The construction of a practical TSI system will now be discussed for various exemplary embodiments of the invention.

There are provided, in accordance with the present invention, (a) a small plasma gun or traveling spark ignitor (also known as a TSI) that substitutes for a conventional spark plug and (b) specially matched electronic trigger (i.e., ignition) circuitry. Matching the electronic circuit to the parameters of the plasma gun (e.g., length of electrodes, diameters of coaxial cylinders, duration of the discharge) maximizes the volume of the plasma when it leaves the gun for a given store of electrical energy. By properly choosing the parameters of the electronic circuit it is possible to obtain current and voltage time profiles so that substantially maximum electrical energy is transferred to the plasma.

Preferably, the TSI ignition system of the present invention uses no more than about 300 mJ per firing. By contrast, earlier plasma and Marshall gun ignitors have not achieved practical utility because they employed much larger ignition energies (e.g., 2–10 Joules per firing), which caused rapid erosion of the ignitor, and short life. Further efficiency gains in engine performance were surrendered by increased ignition system energy consumption.

Heretofore, it had been thought that the proper design principle was to generate moving plasma with a very high speed, which would penetrate the combustible mixture to create a high level of turbulence and ignite a large volume of that mixture. This was accomplished by using a relatively long length of electrodes with a relatively small gap between them. For example, an aspect ratio of electrode length to discharge gap more than 3 and preferably 6–10 was proposed by Matthews et al., supra. By contrast, the present invention uses a relatively short length of electrodes with a relatively large gap between them.

Consider that the kinetic energy of the plasma is proportional to the product of plasma mass, $M_p$, and its velocity, $v_p$, squared, as follows:

$$K.E. \approx M_p v_p^2$$

Doubling the velocity of the plasma multiplies the kinetic energy four-fold. The mass of plasma is $\rho_p \times Vol_p$ where $\rho_p$ and $Vol_p$ are the plasma density and plasma volume, respectively. Thus, if the volume of the plasma is doubled at the same velocity, the required energy is only doubled.

The present invention increases the ratio of plasma volume to energy required to form the plasma. This is done by quickly achieving a modest plasma velocity.

If one assumes a spherical shape for the ignition plasma volume, the surface area of the volume increases as the square of the radius of the volume. Ignition of the combustible mixture occurs at the surface of the plasma volume after the plasma has expanded and cooled to the combustible mixture ignition temperature. Thus, the rate at which the combustible mixture burns initially depends primarily on the plasma temperature and not on its initial velocity. Consequently, maximizing the ratio of plasma volume and temperature to plasma input energy, maximizes the effectiveness of the electrical input energy in speeding up the combustion of the combustible mixture.

The drag, D, on the expanding volume of plasma is proportional to the density of the combustible mixture, PC, and the square of the speed of the expanding plasma, $v_p$, as follows:

$$D \sim \rho_c v_p^2$$

The magnitude of the electrical force, F, to expand the plasma is proportional to the discharge current, I, squared. Equating these two forces yields the following:

$$F \sim I^2 = D \sim \rho_c v_p^2$$

The radius, r, of the plasma volume, $Vol_p$, is proportional to ${}_0\int^{t_D} v_p(t)dt$ where $t_D$ is the duration of the discharge. The volume of the plasma is proportional to the cube of the radius r, while the radius of the plasma volume is proportional to ${}_0\int^{t_D} I(t)dt = Q$, the electric charge inserted into the plasma. Thus, the volume of the plasma is proportional to $Q^3$.

If the source of electrical energy is that stored in a capacitor, then Q=VC, where V is the voltage at which the charge Q is stored and C is the capacitance; and the energy stored in the capacitor is $E = \frac{1}{2} CV^2$.

To maximize the plasma volume for given energy, the ratio of plasma volume, $Vol_p$, to electrical energy, E, has to be maximized. $Vol_p/E$ is proportional to $C^3V^3/CV^2$, which is $C^2V$. For a given constant energy $E = \frac{1}{2} CV^2$, C will be proportional to $V^{-2}$. Hence, $Vol_p/E$ is proportional to $V^{-3}$.

Therefore, the optimum circuit design is one which stores the desired electric energy in a large capacitor at a low voltage.

To enhance efficiency, therefore, the discharge should take place at the lowest possible voltage. To that end, according to the invention the initial discharge of electrical energy takes place on the surface of an insulator, and a power supply is used to raise the gap conductivity near the surface of that insulator, and the main source of discharge energy is stored and provided at the lowest possible voltage that will be effective to create the plasma reliably.

A further objective, preferably, is to avoid recombination of the large amount of ions and electrons of the traveling spark (plasma) on the electrode walls. The energy losses due to the recombination of ions and electrons reduce the efficiency of the system. Since recombination processes increase with time, the ion formation should take place quickly to minimize the probability of interaction of ions with the walls. To reduce recombination, therefore, the discharge time should be short. This can be accomplished by achieving the desired velocity on a short travel distance.

There is a second loss mechanism: the drag force on the plasma as it impacts the combustible mixture ahead of its path. These losses vary as the square of the velocity. Thus the exit velocity should be as low as possible to reduce or minimize such losses.

The high volume that is desired, combined with the need to discharge quickly, leads to a structure characterized by a short length l for plasma travel with a relatively wide gap between electrodes. This requirement is specified geometrically by the two ratio pairs described with reference to FIGS. 2 and 3, above.

What does this mean with respect to physical dimensions? If the volume of the plasma in a point-to-point discharge of a conventional spark plug is about 1 $mm^3$, it would be desirable, preferably, to create a plasma volume at least 100 times greater, i.e., $Vol_p \approx 100\ mm^3$. Thus, using the configuration of FIG. 2, an example satisfying such conditions could be: length l=2.5 mm, the radius (inside) of the larger diameter cylindrical electrode being $r_2$=5.8 mm (this would be a typical radius of the cylindrical electrode using the conventional spark gap with a thread diameter of 14 mm) and the radius of the smaller diameter cylindrical electrode being $r_1$=4.6 mm.

As shown in the embodiments of FIGS. 2 and 3, TSI 17, 27, respectively, share many of the same physical attributes as a standard spark plug, such as standard mounting means or threads 19, a standard male spark plug connector 21, and an insulator 23. The tips or plasma forming portions of the TSI's 17 and 27, respectively, differ significantly from conventional is spark plugs, though. In a Traveling Spark Ignitor (TSI) for one embodiment of the present invention as shown in FIG. 2, an internal electrode 18 is placed with a lower portion extending coaxially into the interior open volume of external electrode 20 distal boot connector 21. The space between the electrodes is filled with an insulating material 22 (e.g., ceramic) except for the last 2 to 3 mm, in this example, at the end of the ignitor 17, this distance being shown as l. The space or discharge gap g, between the electrodes may have a radial distance of about 1.2 to about 1.5 mm, in this example. These distances for l and $g_1$ are important in that the TSI preferably works as a system with the matching electronics (discussed below) in order to obtain maximum efficiency. A discharge between the electrodes 18–20 starts along the exposed interior surface of the insulator 23, since a lower voltage is required to initiate a discharge along the surface of an insulator than in the gas some distance away from the insulator surface. When a voltage is applied, the gas (air/fuel mixture) is ionized by the resulting electrical field, creating a plasma 24 which becomes a good conductor and supports a current between the electrodes at a lower voltage. This current ionizes more gas (air/fuel mixture) and gives rise to a Lorenz force which increases the volume of the plasma 24. In the TSI of FIG. 2, the plasma accelerates out of the "ignitor plug" 17 in the axial direction.

FIG. 3 shows a TSI 27 with an internal electrode 25 that is placed coaxially in the external electrode 28. The space between the electrodes 26 and 28 is filled with an insulating material 30 (e.g., ceramic). The main distinguishing feature for the embodiment of FIG. 3 relative to FIG. 2, is that there is a flat, disk-shaped (circular) electrode surface 26 formed integrally with or attached to the free end of the center electrode 25, extending transversely to the longitudinal axis of electrode 25 and facing electrode 28. Note further that the horizontal plane of disk 26 is parallel to the associated piston head (not shown) when the plasma ignitor 27 is installed in a piston cylinder. The end surface of electrode 28 which faces electrode 26 also is a substantially flat circular shape extending parallel to the facing surface of electrode 26. As a result, an annular cavity 29 is formed between opposing surfaces of electrodes 26 and 28. More precisely, there are two substantially parallel surfaces of electrodes 26 and 28 spaced apart and oriented to be parallel to the top of an associated piston head, as opposed to the embodiment of FIG. 2 wherein the electrodes run perpendicularly to an associated piston head when in use. Consider that when the air/fuel mixture is ignited, the associated piston "rises" and is close to the spark plug or ignitor 27, so that it is preferably further from gap 29 of the ignitor 27 to the wall of the associated cylinder than to the piston head. Accordingly, the preferred direction of travel for the plasma to obtain maximum interaction with the mixture is from the gap 29 to the cylinder wall The essentially parallel electrodes 26 and 28 are substantially parallel to the longest dimension of the volume of the combustible mixture at the moment of ignition, instead of being oriented perpendicularly to this dimension and toward the piston head as in the embodiment of FIG. 2, and the prior art. It was discovered that when the same electrical conditions are used for energizing ignitors 17 and 27, the plasma acceleration lengths l and L, respectively, are substantially equal for obtaining optimal plasma production. Also, for TSI 27, under these conditions the following dimensions work well: the radius of the disk electrode 26 is $R_2$=6.8 mm, the radius of the isolating ceramic is $R_1$=4.3 mm, the gap between the electrodes $g_2$=1.2 mm and the length L=2.5 mm.

In the embodiment of FIG. 3, the plasma 32 initiates in discharge gap 29 at the exposed surface of insulator 30, and grows and expands outwardly in the radial direction of arrows 29A. This provides several additional advantages over the TSI embodiment of FIG. 2. First, the surface area of the disk electrode 26 exposed to the plasma 32 is substantially equal to that of the end portion of the outer electrode 28 exposed to the plasma 32. This means that the erosion of the inner portion of disk electrode 26 can be expected to be significantly less than that of the exposed portion of inner electrode 18 of TSI 17 of FIG. 2, the latter having a much smaller surface area exposed to the plasma. Secondly, the insulator material 30 in the TSI 27 of FIG. 3 provides an additional heat conducting path for electrode 26. The added insulator material 30 will keep the inner electrode metal 25, 26 cooler than electrode 18 in FIG. 2, thereby enhancing the reliability of TSI 27 relative to TSI 17. Finally, in using TSI 27, the plasma will not be impinging on and perhaps eroding the associated piston head.

Figure 5:
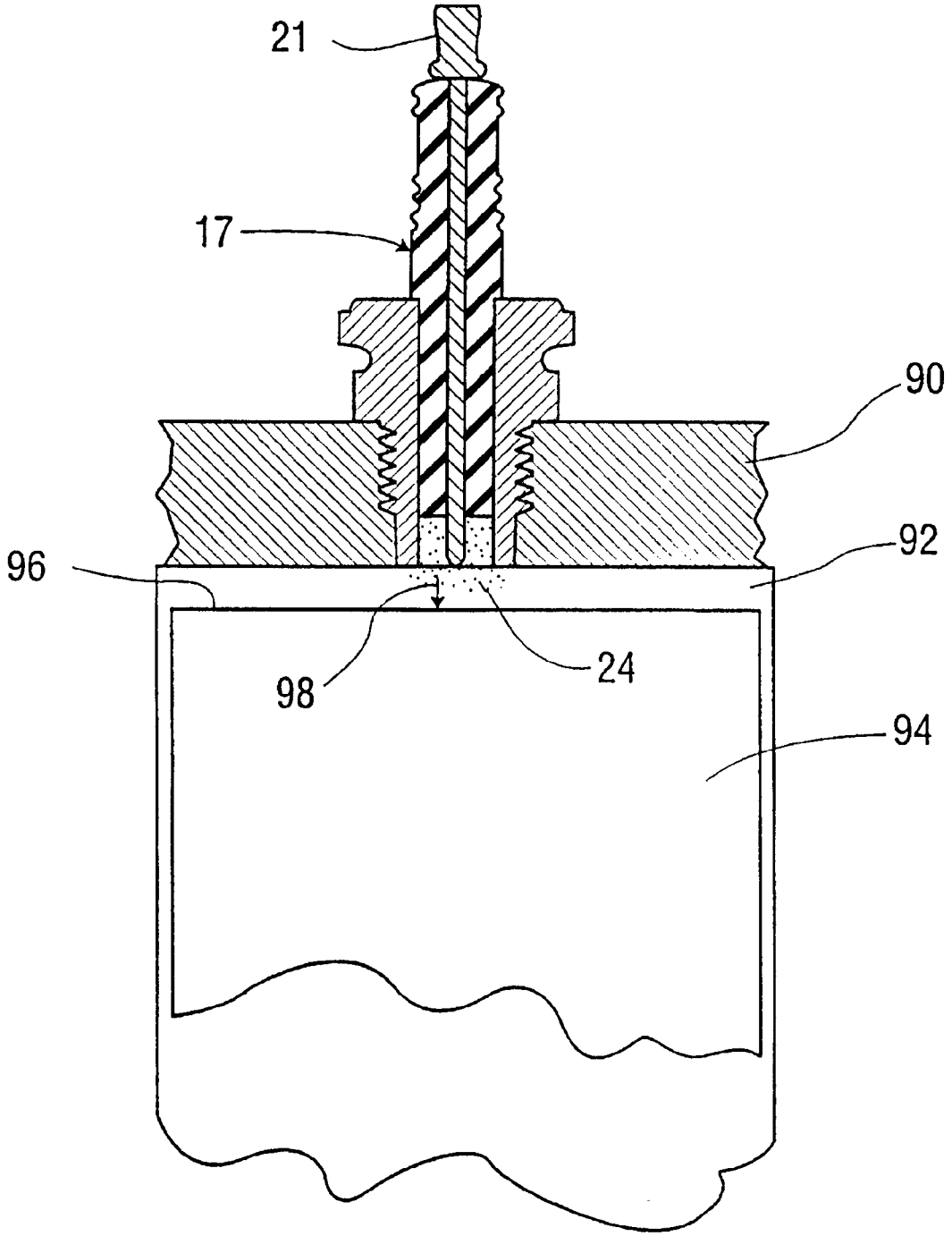
FIG. 5 is a cutaway pictorial view of a traveling spark ignitor for one embodiment of the invention, as installed into a cylinder of an engine.
Figure 6:
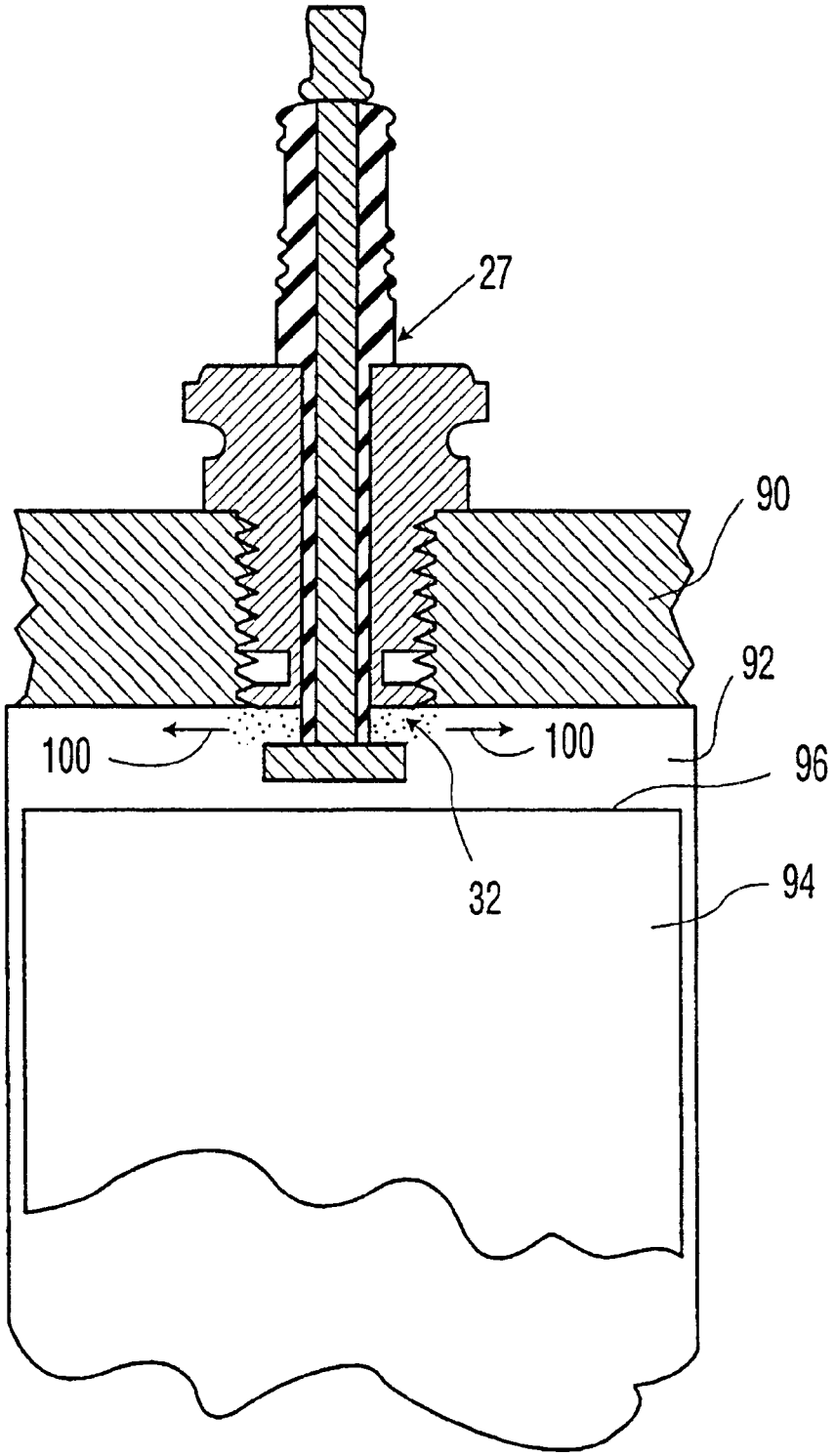
FIG. 6 is a cutaway pictorial view of a traveling spark ignitor for a second embodiment of the invention, as installed into a cylinder of an engine.

FIGS. 5 and 6 illustrate pictorially the differences in plasma trajectories between TSI 17 of FIG. 2, and TSI 27 of FIG. 3 when installed in an engine. In FIG. 5, a TSI 17 is mounted in a cylinder head 90, associated with a cylinder 92 and a piston 94 which is reciprocating—i.e., moving up and down—in the cylinder 92. As in any conventional internal combustion engine, as the piston head 96 nears top dead center, the TSI 17 will be energized. This will produce the plasma 24, which will travel in the direction of arrow 98 only a short distance toward or to the piston head 96. During this travel, the plasma 24 will ignite the air/fuel mixture (not shown) in the cylinder 92. The ignition begins in the vicinity of the plasma 24. In contrast to such travel of plasma 24, the TSI 27, as shown in FIG. 6, provides for the plasma 32 to travel in the direction of arrows 100, resulting in the ignition of a greater amount of air/fuel mixture than provided by TSI 17, as previously explained.

The electrode materials may include any suitable conductor such as steel, clad metals, platinum-plated steel (for erosion resistance or "performance engines"), copper, and high-temperature electrode metals such as molybdenum or tungsten, for example. The metal may be of controlled thermal expansion like Kovar (a trademark and product of Carpenter Technology Corp.) and coated with a material such as cuprous oxide so as to give good subsequent seals to glass or ceramics. Electrode materials may also be selected to reduce power consumption. For instance, thoriated tungsten could be used as its slight radioactivity may help to pre-ionize the air between the electrodes, possibly reducing the required ignition voltage. Also, the electrodes may be made out of high-Curie temperature permanent magnet materials, polarized to assist the Lorentz force in expelling the plasma.

The electrodes, except for a few millimeters at the end, are separated by an isolator or insulator material which is a high temperature, polarizable electrical dielectric. This material can be porcelain, or a fired ceramic with a glaze, as is used in conventional spark plugs, for example. Alternatively, it can be formed of refractory cement, a machinable glass-ceramic such as Macor (a trademark and product of Corning Glass Company), or molded alumina, stabilized zirconia or the like fired and sealed to the metal electrodes with a solder glass frit, for example. As above, the ceramic could also comprise a permanent magnet material such as barium ferrite.

In terms of operation of the embodiments of FIGS. 2 and 3, when the electrodes 18, 20 and 26, 28, respectively, are connected to the rest of the TSI system, they become part of an electrical system which also comprises an electrical circuit for providing potential differences which are sufficiently high to create a spark in the gap between respective electrode pairs. The resulting current in the plasma channel and a magnetic field arising from a current flowing in at least one of the electrodes due to said current through the plasma interact, creating a Lorentz force on the plasma in the spark channel; this effect causes the point of origin of the spark channel to move, and not to remain fixed in position, thus increasing the cross-sectional area of the spark channels, as previously described. This is in contrast to traditional spark ignition systems, wherein the point of origin of the spark remains fixed. Electronic circuits matched to the TSIs 17 and 27 complete the TSI system for each embodiment, and are discussed in the following examples.

EXAMPLE 1

Figure 4:
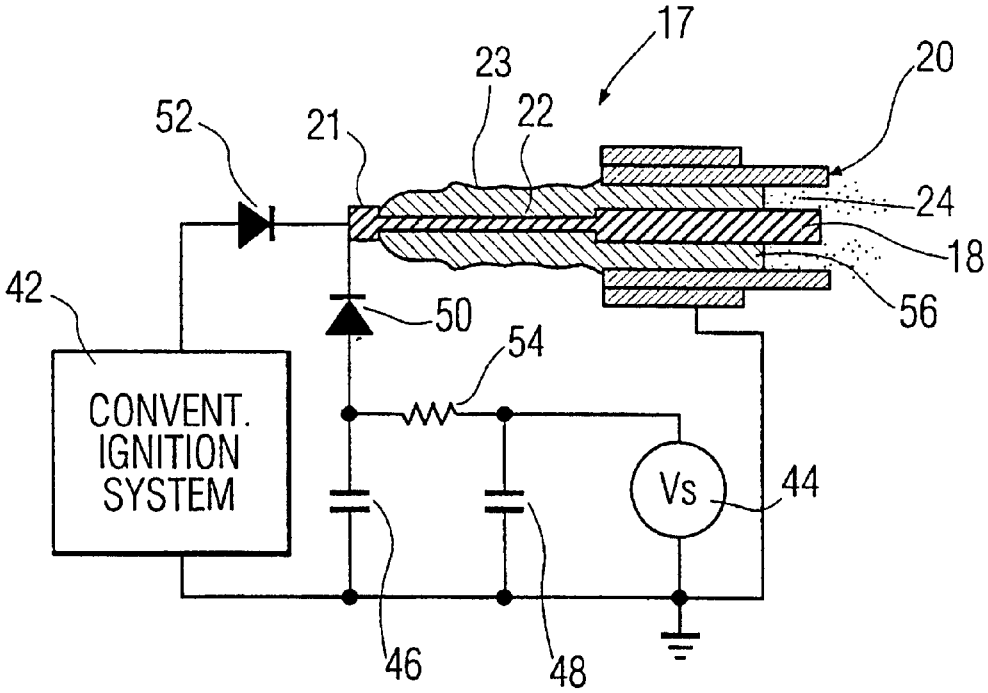
FIG. 4 is an illustration of the ignitor embodiment of FIG. 2 coupled to a schematic diagram of an exemplary electrical ignition circuit to operate the ignitor, according to an embodiment of the invention.

FIG. 4 shows TSI plug or ignitor 17 with a schematic of the basic elements of an electrical or electronic ignition circuit connected thereto, which supplies the voltage and current for the discharge (plasma). (The same circuitry and circuit elements may be used for driving TSI 27.) A discharge between the two electrodes 18 and 20 starts along the surface 56 of the insulator material 22. The gas (air/fuel mixture) is ionized by the discharge, creating a plasma 24 which becomes a good conductor of current and permits current between the electrodes at a lower voltage than that which initiated the plasma. This current ionizes more gas (air/fuel mixture) and increases the volume of the plasma 24. The electrical circuit shown in FIG. 4 includes a conventional ignition system 42 (e.g., capacitive discharge ignition, CDI, or transistorized coil ignition, TCI), a low voltage ($V_S$) supply 44, capacitors 46 and 48 diodes 50 and 52, and a resistor 54. The conventional ignition system 42 provides the high voltage necessary to break down, or ionize, the air/fuel mixture in the gap along the surface 56 of the TSI 17. Once the conducting path has been established, the capacitor 46 quickly discharges through diode 50, providing a high power input, or current, into the plasma 24. The diodes 50 and 52 are necessary to isolate electrically the ignition coil (not shown) of the conventional ignition system 42 from the relatively large capacitor 46 (between 1 and 4 $\mu$F). If the diodes 50, 52 were not present, the coil would not be able to produce a high voltage, due to the low impedance provided by capacitor 46. The coil would instead charge the capacitor 46. The function of the resistor 54, the capacitor 48, and the voltage source 44 is to recharge the capacitor 46 after a discharge cycle. The resistor 54 is one way to prevent a low resistance current path between the voltage source 44 and the spark gap of TSI 17.

Note that the circuit of FIG. 4 is simplified, for purposes of illustration. In a commercial application, the circuit of FIG. 7 described below under the heading "Example 2" is preferred for recharging capacitor 46 in a more energy-efficient manner, using a resonant circuit. Furthermore, the conventional ignition system 42, whose sole purpose is to create the initial breakdown, is modified so as to use less energy and to discharge more quickly than has been conventional. Almost all of the ignition energy is supplied by capacitor 46. The modification is primarily to reduce high voltage coil inductance by the use of fewer secondary turns. This is possible because the initiating discharge can be of a much lower voltage when the discharge occurs over an insulator surface. The voltage required can be about one-third that required to cause a gaseous breakdown in air.

The current through the central electrode 18 and the plasma 24 to the external electrode 20 creates around the central electrode 18 a poloidal (angular) magnetic field $B_\theta$ (I,r), which depends on the current and distance (radius $r_0$, see FIG. 1) from the axis of electrode 18. Hence, the current I flowing through the plasma 24 perpendicular to the poloidal magnetic field B generates a Lorentz force F on the charged particles in the plasma 24 along the axial direction z of the cylinders 18, 20. The force is computed as follows:

$$F \sim I \times B \rightarrow F_Z \sim I_r \cdot B_\theta$$

This force accelerates the charged particles, which due to collisions with non-charged particles accelerate all the plasma. Note that the plasma consists of charged particles (electrons and ions), and neutral atoms. The temperature is not sufficiently high in the discharge to fully ionize all atoms.

The original Marshall guns as a source of plasma for fusion devices were operated in a vacuum with a short pulse of gas injection between the electrodes. The plasma created between the electrodes by the discharge of a capacitor was accelerated in a distance of a dozen centimeters to a final velocity of about $10^7$ cm/sec. The plasma gun used as an engine ignitor herein operates at relatively high gas (air/fuel mixture) pressure. The drag force $F_v$ of such a gas is approximately proportional to the square of the plasma velocity, as shown below:

$$F_v \sim V_p^2$$

The distance over which the plasma accelerates is short (2–3 mm). Indeed, experimentation has shown that increasing the length of the plasma acceleration distance beyond 2 to 3 mm does not increase significantly the plasma exit velocity, although electrical energy stored in the capacitor 46 has to be increased significantly. At atmospheric pressures and for electrical input energy of about 300 mJ, the average velocity is close to $5\times10^4$ cm/sec and will be lower at high pressure in the engine. At a compression ratio of 8:1, this average velocity will be approximately $3\times10^4$ cm/sec.

By contrast, if more energy is put into a single discharge of a conventional spark, its intensity is increased somewhat, but the volume of the plasma created does not increase significantly. In a conventional spark, a much larger fraction of the energy input goes into heating the electrodes when the conductivity of the discharge path is increased.

EXAMPLE 2

Figure 7:
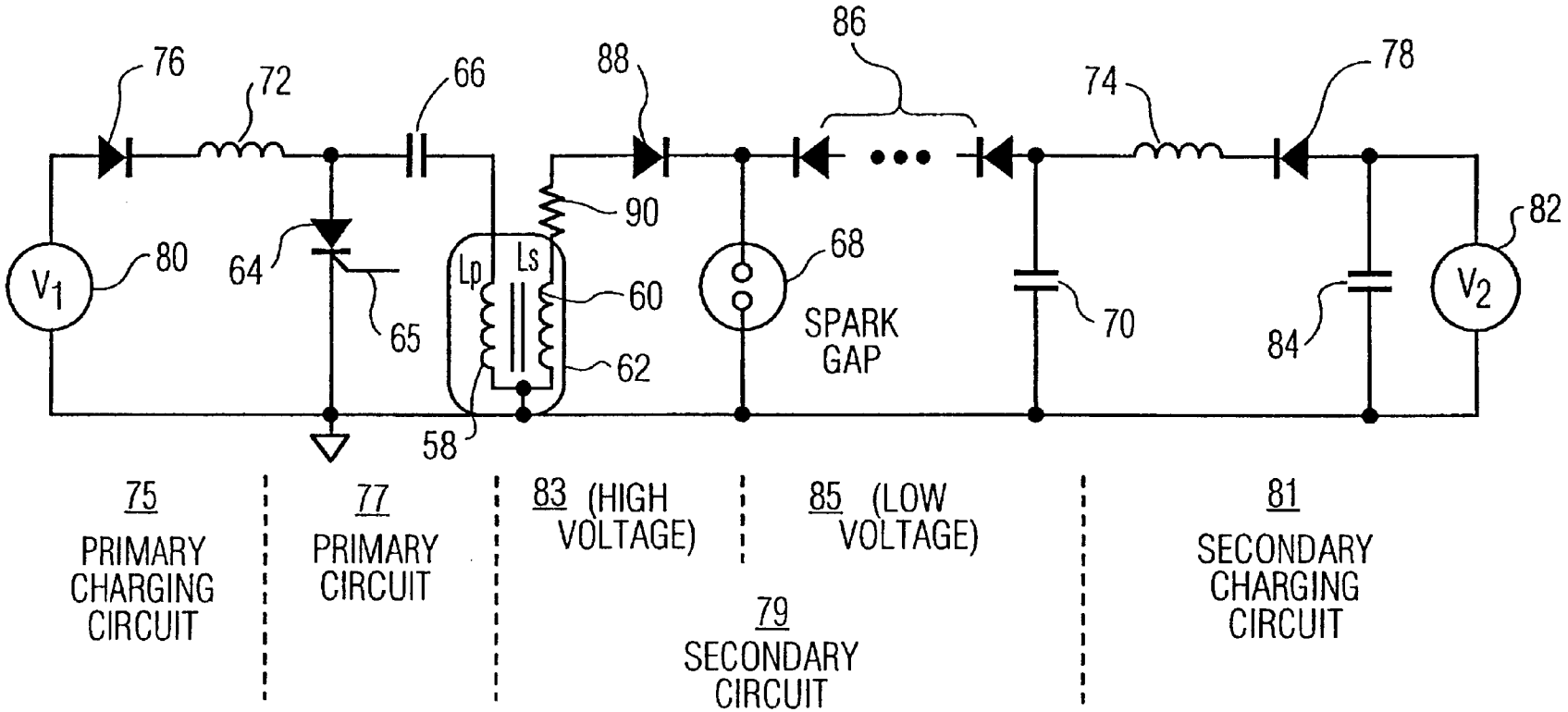
FIG. 7 shows a circuit schematic diagram of another ignition circuit embodiment according to the invention.

TSI ignitors 17 and 27 of FIGS. 2 and 3, respectively, can be combined with the ignition electronics shown in FIG. 7. The ignition electronics can be divided into four parts, as shown: the primary and secondary circuits 77, 79, respectively, and their associated charging circuits 75, 81, respectively. The secondary circuit 79, in turn, is divided into a high voltage section 83, and a low voltage section 85.

The primary and secondary circuits 77, 79, respectively, correspond to primary 58 and secondary 60 windings of an ignition coil 62. When the SCR 64 is turned on via application of a trigger signal to its gate 65, the capacitor 66 discharges through the SCR 64, which causes a current in the coil primary winding 58. This in turn imparts a high voltage across the associated secondary winding 60, which causes the gas in the spark gap 68 to break down and form a conductive path, i.e. a plasma. Once the plasma has been created, diodes 86 turn on and the secondary capacitor 70 discharges. The spark gap symbol 68 is representative of an ignitor, according to the invention, such as exemplary TSI devices 17 and 27 of FIGS. 2 and 3, respectively.

After the primary and secondary capacitors 66 and 70 have discharged, they are recharged by their respective charging circuits 75 and 81. Both charging circuits 75, 81 incorporate an inductor 72, 74 (respectively) and a diode 76, 78 (respectively), together with a power supply 80, 82 (respectively). The function of the inductor 72, 74 is to prevent the power supplies from being short-circuited through the ignitor. The function of the diodes 76 and 78 is to avoid oscillations. The capacitor 84 prevents the power supply 82 voltage $V_2$ from the going through large fluctuations.

The power supplies 80 and 82 both supply on the order of 500 volts or less for voltages $V_1$ and $V_2$, respectively. They could be combined into one power supply. (In experiments conducted by the inventors these power supplies were kept separate to make it easier to vary the two voltages independently.) Power supplies 80 and 82 may be DC-to-DC converters from a CDI (capacitive discharge ignition) system, which can be powered by a 12 volt car battery, for example.

An essential part of the ignition circuit of FIG. 7 are one or more high current diodes 86, which have a high reverse breakdown voltage, larger than the maximum spark gap breakdown voltage of either TSI 17 or TSI 27, for all engine operating conditions. The function of the diodes 86 is to isolate the secondary capacitor 70 from the ignition coil 62, by blocking current from secondary winding 60 to capacitor 70. If this isolation were not present, the secondary voltage of ignition coil 62 would charge the secondary capacitor 70, and, given a large capacitance, the ignition coil 62 would never be able to develop a sufficiently high voltage to break down the air/fuel mixture in spark gap 68.

Diode 88 prevents capacitor 70 from discharging through the secondary winding 60 when there is no spark or plasma. Finally, the optional resistor 90 may be used to reduce current through secondary winding 60, thereby reducing electromagnetic radiation (radio noise) emitted by the circuit.

In the present TSI system, a trigger electrode can be added between the inner and outer electrodes of FIGS. 2 through 4 to lower the voltage on capacitor 70 in FIG. 7. Such a three electrode ignitor is shown in FIG. 8, and is described in the following paragraph.

Figure 8:
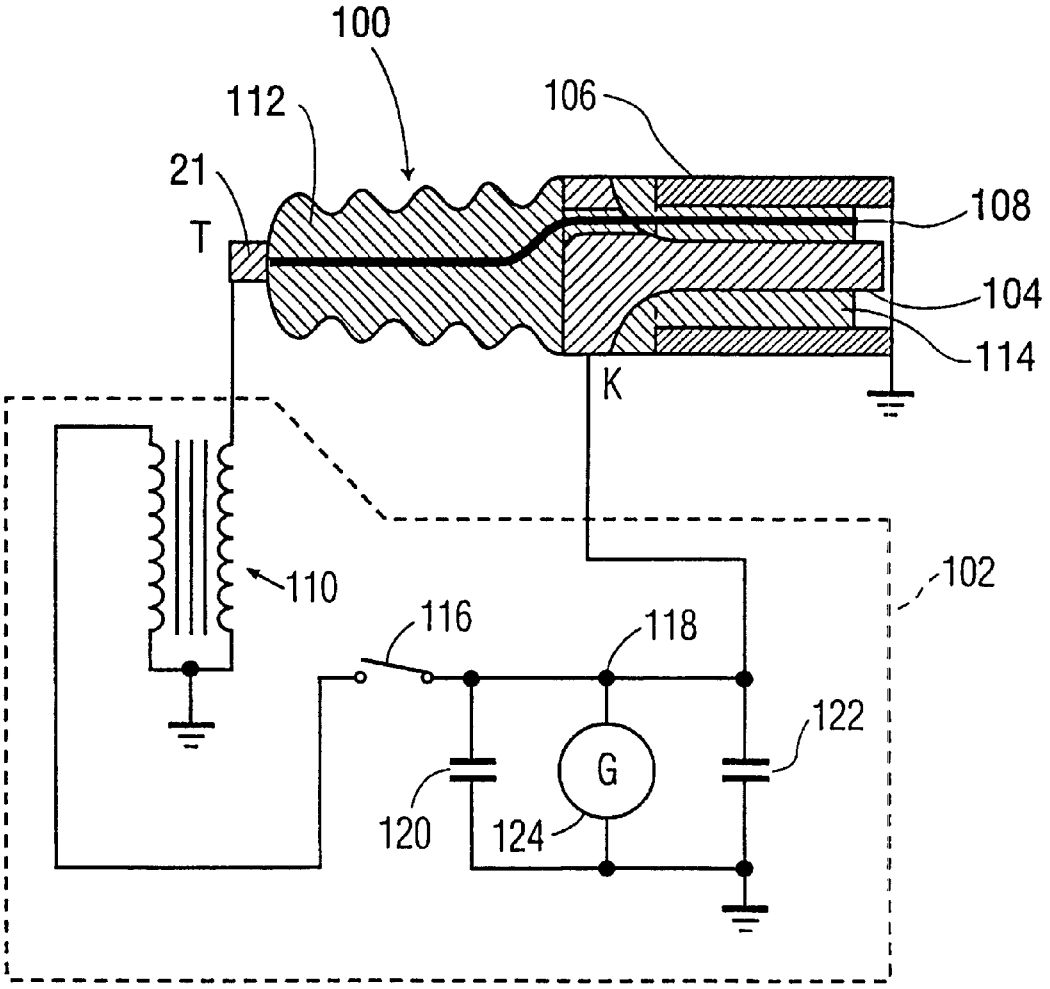
FIG. 8 shows a cross-sectional view of yet another traveling spark ignitor for an embodiment of the invention.

In FIG. 8, a three electrode plasma ignitor 100 is shown schematically. An internal electrode 104 is placed coaxially within the external electrode 106, both having diameters on the order of several millimeters. Radially between the internal electrode 104 and the external 106 is a third electrode 108. This third electrode 108 is connected to a high voltage (HV) coil 110. The third electrode 108 initiates a discharge between the two main electrodes 104 and 106 by charging the exposed surface 114 of the insulator 112. The space between all three electrodes 104, 106, 108 is filled with insulating material 112 (e.g., ceramic) except for the last 2–3 mm space between electrodes 104 and 106 at the combustion end of the ignitor 100. A discharge between the two main electrodes 104 and 106, after initiation by the third electrode 108, starts along the surface 114 of the insulator 112. The gas (air-fuel mixture) is ionized by the discharge. This discharge creates a plasma, which becomes a good electrical conductor and permits an increase in the magnitude of the current. The increased current ionizes more gas (air-fuel mixture) and increases the volume of the plasma, as previously explained.

The high voltage between the tip of the third electrode 108 and the external electrode 106 provides a very low current discharge, which is sufficient to create enough charged particles on the surface 114 of the insulator 112 for the main capacitor to discharge between electrodes 104 and 106 along surface 114 of dielectric or insulator 112.

Figure 9A:
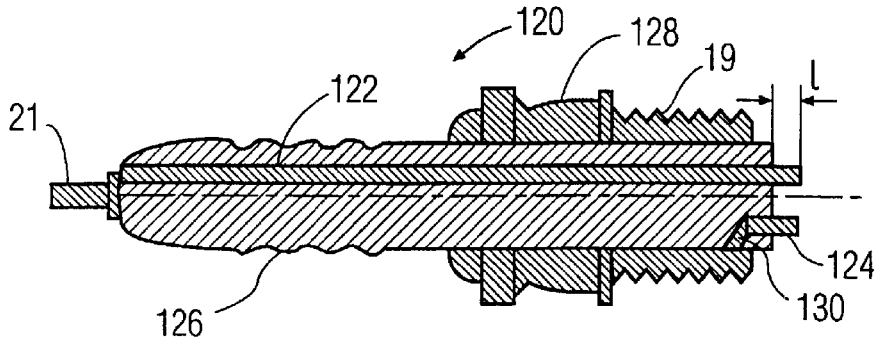
FIG. 9A shows a longitudinal cross-sectional view of another traveling spark ignitor for another embodiment of the invention.
Figure 9B:
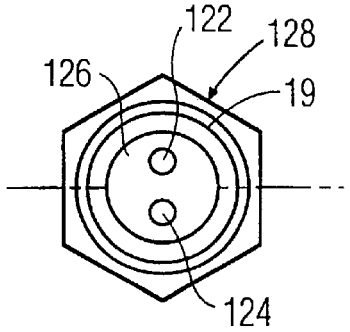
FIG. 9B is an end view of the traveling spark ignitor of FIG. 9A showing the free ends of opposing electrodes.
Figure 9C:
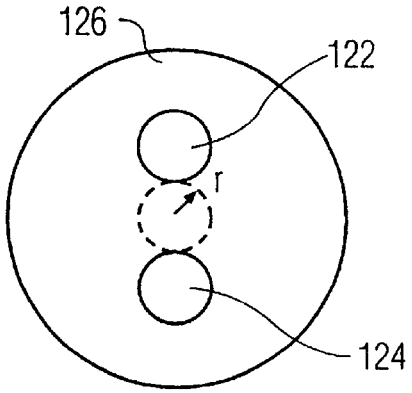
FIG. 9C is an enlarged view of a portion of FIG. 9B.

As shown in FIGS. 9A, 9B and 9C, another embodiment of the invention includes a traveling spark ignitor 120 having parallel rod-shaped electrodes 122 and 124, as shown. The parallel electrodes 122, 124 have a substantial portion of their respective lengths encapsulated by dielectric insulator material 126, as shown. A top end of the dielectric 126 retains a spark plug boot connector 21 that is both mechanically and electrically secured to the top end of electrode 122. The dielectric material 126 rigidly retains electrodes 122 and 124 in parallel, and a portion rigidly retains the outer metallic body 128 having mounting threads 19 about a lower portion, as shown. Electrode 124 is both mechanically and electrically secured to an inside wall of metallic body 128 via a rigid mount 130, as shown, in this example. As shown in FIG. 9A, each of the electrodes 122 and 124 extends a distance I outwardly from the surface of the bottom end of dielectric 126.

With reference to FIGS. 9B and 9C, the electrodes 122 and 124 are spaced apart a distance 2 r, where r is the radius of the largest cylinder that can fit between the electrodes 122, 124 (see FIG. 9C).

Although various embodiments of the invention are shown and described herein, they are not meant to be limiting as they are shown by way of example only. For example, the electrodes 18 and 20 of TSI 17, and 25 of TSI 27 can be other than cylindrical. Also, the disk shaped electrode 26 can be other than circular—a straight rod, for example. For TSI 17, the electrodes 18 and 20 may also be other than coaxial, such as parallel rods or parallel elongated rectangular configurations. Although the electrodes are shown as presenting equal lengths, this too may be varied, in which event the term "length" as used in the claims shall refer to the dimension of electrode overlap along the direction of plasma ejection from the ignitor. Those of skill in the art will recognize still further modifications to the embodiments, which modifications are meant to be covered by the spirit and scope of the appended claims.

What is claimed is:

1. A traveling spark ignition (TSI) system for a combustion engine, comprising:

an ignitor including:

substantially parallel and spaced apart electrodes, including at least first and second electrodes forming a discharge gap between them, the first electrode being an outer electrode and the second electrode being an inner electrode and both electrodes having substantially circular configurations in cross-section, an outer radius of the inner electrode and an inner radius of the outer electrode being referred to as the radii of the electrodes, the length of a said electrode being relatively short with respect to the dimension of the gap and the dimension of the gap being relatively large with respect to said length, such that the ratio of the sum of the radii of said electrodes to the length of the said electrodes is larger than or equal to about four, while the ratio of the difference of these two radii to the length of the said electrode is larger than about one-third;

electrically insulating material filling a substantial portion of the space between said electrodes and forming a surface between the at least first and second electrodes;

an uninsulated end portion of each of said electrodes being free of said electrically insulating material and in oppositional relationship to one another;

means for mounting said ignitor with said free ends of said first and second electrodes installed in a combustion cylinder of said engine; and electrical means for providing a potential difference between said electrodes for initially providing thereto a sufficiently high first voltage for creating a channel formed of plasma between said electrodes, and a second voltage of lower amplitude than said first voltage, for sustaining a current through the plasma in said channel between said electrodes, whereby said current through the plasma and a magnetic field arising from a current flowing in at least one of the electrodes due to said current through the plasma interact in a manner creating a Lorentz force upon said plasma that, in combination with thermal expansion forces, causes it to move away from its region of origin, thereby increasing the volume of said plasma.

2. The TSI system of claim 1, wherein said electrical means includes:

a first voltage source for providing said first voltage having a relatively high amplitude but low magnitude of current; and a second voltage source for providing said second voltage of substantially lower amplitude than the first voltage but with higher magnitude of current relative to that from said first voltage source.

3. The TSI system of claim 1, further including:

said ignitor further including a third electrode located between said first and second electrodes; and said first voltage being applied between said second and third electrodes, and said second voltage being applied between said first electrode and said second electrode.

4. The TSI system of claim 1, wherein said first and second electrodes are concentric parallel cylinders.

5. The TSI system of claim 1, wherein said first and second electrodes are of the same length.

6. The TSI system of claim 1, wherein the axial length of the uninsulated portion of the first and second electrodes is smaller than or equal to about 3 mm and the radial separation of the electrodes is from about 1 mm to about 3 mm.

7. The TSI system of claim 1, wherein said parallel first and second electrodes are parallel to a longitudinal axis of said ignitor.

8. The TSI system of claim 1, wherein uninsulated surfaces of the said parallel first and second electrodes that face each other are of the form of annular sections of disks oriented in a plane perpendicular to a longitudinal axis of said ignitor.

9. The TSI system of claim 8, wherein the radial width of said uninsulated part of annular disks is smaller or equal to about 3 mm and the separation of the electrodes is about 1 mm to about 3 mm.

10. The TSI system of claim 1, wherein the total energy provided to the ignitor is less than about 300 mj.

11. The TSI system of claim 1, wherein the air-to-fuel ratio of the mixture of air-fuel is leaner that a stoichiometric mixture.

12. The TSI system of claim 1, wherein the first high voltage causes an initial discharge between the electrodes that occurs on or in the vicinity of the electrically insulating surface.

13. The TSI system of claim 1, wherein the first high voltage causes an initial discharge between the electrodes that occurs on the electrically insulating surface.

14. The TSI system of claim 1, wherein the electrical means provide the first and second voltages such that the total energy provided to the ignitor per discharge is less that about 1 percent of the energy available in the ignited mixture.

15. The TSI system of claims 1, 6, 8, 9, 12 or 13 wherein the electrically insulating material is a dielectric material.

16. A traveling spark ignition (TSI) system for a combustion engine operating with an air-fuel mixture, comprising:

an ignitor including:

at least two spaced apart electrodes adapted for forming a discharge gap between them, the length of at least one of the electrodes being relatively short with respect to the width of the gap and the width of the gap being relatively large with respect to said length;

electrically insulating material filling a substantial portion of the space between said electrodes and forming a surface between the electrodes;

an uninsulated end portion of each of said electrodes being free of said electrically insulating material and in oppositional relationship to one another, said uninsulated end portions being designated the lengths of said electrodes, respectively;

means for mounting said ignitor with said free ends of said electrodes in a combustion cylinder of an engine; and electrical means for providing two voltages between said electrodes, the first voltage applied being sufficiently high for creating, from the air-fuel mixture, a channel formed of plasma between said electrodes, and the second voltage applied of lower amplitude than said first voltage, for sustaining a current through the plasma in said channel between said electrodes, whereby said current through the plasma and a magnetic field arising from said a current flowing in at least one of the electrodes due to said current through the plasma interact in a manner creating a Lorentz force upon said plasma that, in combination with thermal expansion forces, causes it to move longitudinally away from its region of origin between the electrodes, thereby substantially increasing the volume swept by said plasma.

17. The TSI system of claim 16, wherein the first voltage causes an initial discharge between the electrodes that occurs on or in the vicinity of the surface of the electrically insulating material.

18. The TSI system of claim 16, wherein the first voltage causes an initial discharge between said electrodes that occurs on the surface of the electrically insulating material.

19. The TSI system of claim 16, wherein the electrical means provide the first and second voltages such that the total energy provided to the ignitor per discharge is less than about 1 percent of the energy available in a combustible mixture contained in the combustion cylinder.

20. The TSI system of claim 16, wherein the electrical means provide the first and second voltages such that the total energy provided to the ignitor is less that about 300 mj per discharge.

21. The TSI system of claim 16, wherein at least two of the said electrodes are parallel to a longitudinal axis of said ignitor.

22. The TSI system of claim 21, wherein said electrodes are parallel cylinders.

23. The TSI system of claim 16, wherein said electrodes are parallel.

24. The TSI system of claim 16, wherein at least two of said electrodes are of the same length.

25. The TSI system of claim 16, wherein the axial length of the uninsulated portion of the shortest electrode is smaller than or equal to about 3 mm and the width of the discharge gap is from about 1 mm to about 3 mm.

26. The TSI system of claim 16, wherein uninsulated surfaces of said electrodes are parallel and are of the form of annular sections of disks oriented in a plane perpendicular to a longitudinal axis of said ignitor.

27. The TSI system of claim 26, wherein the radial width of said uninsulated part of the annular disk of smaller radius is smaller or equal to about 3 mm and the separation of the disk electrodes is about 1 mm to about 3 mm.

28. The TSI system of claim 16, and wherein the air-to-fuel ratio of the combustible mixture is leaner than a stoichiometric mixture.

29. The TSI system of claim 16, wherein said electrodes are spaced apart and approximately parallel longitudinal electrodes.

30. The TSI system of any of claims 16, and 17–29, wherein the radius of the largest cylinder which theoretically can fit between the electrodes is greater than the length of the shortest electrode divided by six.

31. The TSI system of any of claims 16, and 17–29, wherein the electrically insulating material is a dielectric material.

32. A plasma ignitor for a combustion system, comprising:

at least first and second electrodes;

means for maintaining said electrodes in predetermined, spaced-apart relationship to establish a discharge gap between them;

the electrodes being dimensioned and configured and their spacing being arranged so that a length of at least one of the electrodes is relatively short with respect to the width of the gap and the width of the gap is relatively large with respect to said length, such that when sufficiently high first and second voltages are applied across the electrodes while the ignitor is installed in a combustion region of the combustion system, a plasma is formed between the electrodes and said plasma moves outward between the electrodes into the combustion region, under Lorentz and thermal forces;

means for mounting the ignitor with active portions of said electrodes installed in the combustion region.

33. The ignitor of claim 32, wherein the electrodes have substantially circular surfaces facing each other in parallel, spaced apart relationship with radii and separation suitable for formation of the plasma and the plasma moving radially outward when the first and second voltages are applied.

34. The ignitor of claim 32, wherein the electrodes are spaced apart and approximately parallel longitudinal electrodes, and the plasma moves longitudinally outward between the electrodes when the first and second voltages are applied.

35. The ignitor of claim 34, further including an electically insulating material surrounding a substantial portion of the electrodes and filling a substantial portion of the space between them; an uninsulated end portion of each of the electrodes is free of the electrically insulating material and said end portions are disposed in oppositional relationship to one another, the uninsulated end portions being designated the lengths of the electrodes; and the radius of the largest cylinder which theoretically can fit between the electrodes within the entire length of the discharge gap is greater than the length of the shortest electrode divided by six.

36. The ignitor of any of claims 33–35, wherein the electrodes are coaxial and the ratio of the sum of the radii to the length of the electrodes is larger than or equal to about four, while the ratio of the difference of these two radii to the length of the electrodes is larger than about one-third.

37. The ignitor of claim 34, wherein an electrically insulating material surrounds a substantial portion of the electrodes and fills a substantial portion of the space between them; and an uninsulated end portion of each of the electrodes is free of said electrically insulating material and said end portions are disposed in oppositional relationship to one another.

38. The ignitor of claim 32, wherein an electrically insulating material fills a substantial portion of the space between the electrodes and forms a surface, and wherein an uninsulated end portion of each of the electrodes is free of the electrically insulating material and the end portions are in oppositional relationship to one another, such that as said voltage is applied, the plasma is formed first on or in the vicinity of the surface of the electrically insulating dielectric material.

39. The ignitor of claim 32, further including:

a third electrode located between said first and second electrodes; and said high voltage being applied between said second and third electrodes, and a second voltage, lower than said high voltage, being applied between said first electrode and said second electrode.

40. The ignitor of claim 32, wherein said Lorentz force results from the interaction of a current passing through the plasma and a magnetic field arising from a current flowing in a least in at least one of the electrodes due to the current passing through the plasma.

41. The ignitor of claim 40, wherein the minimal length of said electrodes is such that it allows the plasma to move away from the initiation region under the effect of the Lorentz Force generated by the electrical current.

42. The ignitor of claim 32, wherein the first and second voltages are applied such that the total energy provided to the ignitor per discharge is less than about 1 percent of the available energy of the ignited mixture.

43. The ignitor of claim 32, wherein the electrical means provide the first and second voltages such that the total energy provided to the ignitor is less than about 300 mJ per discharge.

44. The ignitor of claim 32, wherein the discharge initiation region is defined as the lowest electrical breakdown resistance region of the discharge gap, the width of the discharge gap is defined by the distance between the first and second electrodes at the discharge initiation region, the length of the discharge gap is defined by the distance from the discharge initiation region to the end of the shortest electrode, and the discharge gap width is greater than one-third of the discharge gap length.

45. The ignitor of claim 44, wherein the discharge gap width is greater than one-half of the discharge gap length.

46. The ignitor of claim 32, wherein an electrically insulating material fills a substantial portion of the space between the electrodes forming a surface, and the uninsulated ends of the electrodes form a discharge gap, such that as said voltage is applied, the plasma is formed first on the surface of the electrically insulating material.

47. The ignitor of claim 44, wherein an electrically insulating material fills a substantial portion of the space between the electrodes forming a surface, and the uninsulated ends of the electrodes form a discharge gap, such that as said voltage is applied, the plasma is formed first on or near the surface of the electrically insulating material.

48. The ignitor of claim 45, wherein an electrically insulating material fills a substantial portion of the space between the electrodes forming a surface, and the uninsulated ends of the electrodes from a discharge gap, such that as said voltage is applied, the plasma is formed first on or near the surface of the electrically insulating material.

49. The ignitor of claim 44, wherein an electrically insulating material fills a substantial portion of the space between the electrodes forming a surface, and the uninsulated ends of the electrodes form a discharge gap, such that as said voltage is applied, the plasma is formed first on the surface of the electrically insulating material.

50. The ignitor of claim 45, wherein an electrically insulating material fills a substantial portion of the space between the electrodes forming a surface, and the uninsulated ends of the electrodes form a discharge gap, such that as said voltage is applied, the plasma is formed first on the surface of the electrically insulating material.

51. The ignitor of claim 32, wherein a substantial portion of the space between the electrodes is filled with electricity insulating material and the length of the discharge gap is defined by the overlapping length of the uninsulated ends of said electrodes, and the discharge gap width is greater than one-third of the discharge gap length.

52. The ignitor of claim 51, wherein the discharge gap width is greater than one-half of the discharge gap length.

53. The ignitor of claim 51, wherein the first voltage causes an initial electrical breakdown between the electrodes on or near the surface of the electrically insulating material.

54. The ignitor of claim 52, wherein the first voltage causes an initial electrical breakdown between the electrodes on or near the electrically insulating surface.

55. The ignitor of claim 32, in combination with an internal combustion engine having a combustion cylinder, wherein the air-to-fuel ratio of the air-fuel mixture is leaner than stoichiometric.

56. The ignitor of claim 32 in combination with a combustion system, wherein an air-to-fuel ratio of the air-fuel mixture in the combustion region is leaner than stoichiometric.

57. The ignitor of any of claims 32–34, 40–56 wherein at least a portion of at least one of the electrodes is formed of a magnetic material which creates an additional magnetic field in the gap, which increases the magnitude of the Lorentz force acting on the plasma.

58. The ignitor of any of claims 35, 48, and 40–55 wherein at least a portion of at least one of the electrodes is formed of a magnetic material which creates an additional magnetic field in the gap which increases the magnitude of the Lorentz force acting on the plasma, and wherein the electrically insulating material is a dielectric material.

59. The ignitor of any of claims 35, 38, and 40–53 wherein the electrically insulating material is a dielectric material.

60. A traveling spark ignition (TSI) system for a combustion system comprising:

an ignitor;

and electrical circuitry;

wherein the ignitor includes at least two apart electrodes and an electrically insulating material filling a substantial portion of the volume between said electrodes and forming a surface between said electrodes, the unfilled volume between the electrodes forming a discharge gap including a discharge initiation region, and said electrodes are arranged and configured such that a width of the discharge gap is relatively large with respect to its length;

wherein the electrical circuitry is coupled to said electrodes and provides a first voltage which causes a plasma channel to be formed between the electrodes at the discharge initiation region and, a second voltage that sustains a current through the plasma, and wherein the current through the plasma and a magnetic field, caused by a current flowing through at least one of the electrodes due to the current through the plasma, interact creating a Lorentz force acting on the plasma that, in combination with thermal expansion forces, causes the plasma to expand and move away from the initiation region.

61. The TSI system of claim 60, wherein the electrodes are spaced apart, approximately parallel and longitudinal, and wherein the application of the first and second voltages produces sufficient current flow in the plasma to cause the plasma to move longitudinally outward between the electrodes.

62. The TSI system of claim 61, wherein the length of the electrodes of the discharge gap is such that it allows the plasma to move away from the discharge initiation region under the effect of the Lorentz Force generated by the electrical current.

63. The TSI system of claim 60, wherein the length of the electrodes of the discharge gap is such that it allows the plasma to move awat from the discharge initiation region under the effect of the Lorentz Force generated by the electrical current.

64. The TSI system of claim 60, wherein the length of the discharge gap is defined by the length of the shortest electrode measured from the discharge initiation region, which is the region of the discharge gap having the lowest electrical breakdown resistance, and the width of a discharge gap is defined by the diameter of the largest cylinder which can fit between the electrodes within the entire length of the discharge gap, and wherein the discharge gap width is greater than one-third of the discharge gap length.

65. The TSI system of claim 64, wherein the discharge gap width is greater than one-half of the discharge gap length.

66. The TSI system of claim 60, wherein a substantial portion of the space between the electrodes is filled with electrically insulating material and the length of the discharge gap is defined by the overlapping length of the uninsulated ends of said electrodes, and the width of the discharge gap is defined by the diameter of the largest cylinder which can fit between the electrodes, and said discharge gap width is greater than one-third of the discharge gap length.

67. The TSI system of claim 66, wherein the discharge gap width is greater than one-half of the discharge gap length.

68. The TSI system of claim 60, wherein the initiation region is on or near the surface of the electrically insulating material between said electrodes of the discharge gap.

69. The TSI system of claim 61, wherein the initiation region is on or near the surface of the electrically insulating material between said electrodes of the discharge gap.

70. The TSI system of claim 62, wherein the initiation region is on or near the surface of the electrically insulating material between said electrodes of the discharge gap.

71. The TSI system of claim 63, wherein the initiation region is on or near the surface of the electrically insulating material between said electrodes of the discharge gap.

72. The TSI system of claim 64, wherein the initiation region is on or near the surface of the electrically insulating material between said electrodes of the discharge gap.

73. The TSI system of calim 65, wherein the initiation region is on or near the surface of the electrically insulating material between said electrodes of the discharge gap.

74. The TSI system of claim 66, wherein the initiation region is on or near the surface of the electrically insulating material between said electrodes of the discharge gap.

75. The TSI system of claim 67, wherein the initiation region is on or near the surface of the electrically insulating material between said electrodes of the discharge gap.

76. The TSI system of claim 60, wherein the initiation region is on the surface of the electrically insulating material between said electrodes of the discharge gap.

77. The TSI system of claim 61, wherein the initiation region is on the surface of the electrically insulating material between said electrodes of the discharge gap.

78. The TSI system of claim 62, wherein the initiation region is on the surface of the electrically insulating material between said electrodes of the discharge gap.

79. The TSI system of claim 63, wherein the initiation region is on the surface of the electrically insulating material between said electrodes of the discharge gap.

80. The TSI system of claim 64, wherein the initiation region is on the surface of the electrically insulating material between said electrodes of the discharge gap.

81. The TSI system of claim 65, wherein the initiation region is on the surface of the electrically insulatin material between said electrodes of the discharge gap.

82. The TSI system of claim 66, wherein the initiation region is on the surface of the electrically insulating material between said electrodes of the discharge gap.

83. The TSI system of claim 67, wherein the initiation region is on the surface of the electrically insulating material between said electrodes of the discharge gap.

84. The TSI system of claim 60, wherein said electrodes of the discharge gap are arranged and configured and the second voltage is applied such that surface recombination losses are controlled as a result of moving the plasma.

85. The TSI system of claim 60, wherein the first voltage is of a equal or higher amplitude to the second voltage.

86. The TSI system of claim 60, wherein the second voltage applied is of relatively lower amplitude and higher sustained current than the first voltage.

87. The TSI system of claim 60, wherein the combustion system is an internal combustion engine having at least one combustion cylinder.

88. The TSI system of claim 60, wherein an air-to-fuel ratio of the combustible mixture in the combustion region is leaner than stoichiometric.

89. The TSI system of claim 87, wherein an air-to-fuel ratio of the combustible mixture in the combustion region is leaner than stoichiometric.

90. The TSI system of claim 60, wherein said electrodes are parallel to one another.

91. The TSI system of claim 90, wherein said electroeds are cylinders.

92. The TSI system of claim 91, wherein said electrodes are concentric.

93. The TSI system of claim 60, wherein said electrodes are of the same length.

94. The TSI system of claim 60, wherein the axial length of the uninsulted portion of the shortest electrode is smaller than or equal to about 3 mm and the width of the discharge gap is from abut 1 mm to about 3 mm.

95. The TSI system of any claims 60–94, wherein said electrodes are parallel to a longitudinal axis of said ignitor.

96. The TSI system of claim 60, wherein the uninsulated surfaces of the first and second electrodes are parallel to each other and are of the form of annular sections of disks oriented in a plane perpendicular to a longitudinal axis of said ignitor.

97. The TSI system of claim 96, wherein the radial width of said uninsulated part of the annular disk of smaller radius is smaller or equal to about 3 mm and the separation of the disk electrodes is about 1 mm to about 3 mm

98. The TSI system of any claims 60–94, wherein the ignitor further includes:

a third electrode located between said first and second electrodes; and wherein said high voltage is applied between said second and third electrodes, and a second voltage, of lower magnitude than said high voltage, is applied between said first electrode and said second electrode.

99. The TSI system of any claims 60–94, wherein the electrical circuitry provides the first and second voltages such that the total energy provided to the ignitor per discharge is less than about 1 percent of the energy of the ignited mixture.

100. The TSI system of any of claims 60–94, wherein the electrical circuitry provides the first and second voltages such that the total energy provided to the ignitor per discharge is less than about 300 mJ.

101. The TSI system of any of claims 60–94, 96, and 97, wherein the electrically insulating material is a dielectric material.

102. The TSI system of any of claims 60–94, 96, and 97, wherein at least a portion of at least one of said electrodes is formed of a magnetic material which creates an additional magnetic field in the gap which increases the magnitude of the Lorentz force acting on the plasma.

103. The system of claim 60, wherein the incremental energy input into the electrical means as compared to a conventional TCI or CDI system is less than the incremental energy output of the combustion system.

104. A method of producing a large volume of moving plasma, comprising:

providing an ignitor with a discharge gap between at least two electrodes, wherein the width of the discharge gap is relatively large with respect to its length, and wherein the discharge initiation region is a region of the discharge gap having reduced discharge initiation requirements as compared to other regions of the discharging gap; and applying a high current electrical pulse to the ignitor after initial electrical breakdown between said electrodes to increase the plasma volume while moving the plasma away from the initiation region.

105. The method of claim 104, wherein the step of providing the ignitor includes providing an ignitor including an insulating material disposed between the electrodes, and said insulating material having an upper surface which defines the discharge initiation region.

106. The method of claim 105, wherein the insulating material is a dielectric material.

107. The method of claim 104, wherein the high current electrical pulse is of sufficient amplitude and duration and the electrodes within the discharge gap are of sufficient length to cause the plasma ionization region to move along the electrodes, away from the initiation region under a Lorentz force.

108. The method of claim 104, further including the step of adjusting the amplitude and duration of the high current pulse to control the velocity of the plasma as is transits the discharge gap in order to control plasma drag losses and recombination processes.

109. The method of claim 104, further including the step of mounting the ignitor into a combustion system such that the discharge gap is exposed to the combustion region.

110. The method of claim 104, further including the step of mounting the ignitor into a cylinder of an internal combustion engine so that the discharge gap of the ignitor is exposed to the combustion region.

111. The method of claim 110, further comprising the step of adjusting the ignition timing of the internal combustion engine.

112. The method of claim 111, whereinthe step of adjusting the ignition timing includes a step of adjusting the ignition timing for at least a portion of the operating envelope of the internal combustion engine to control the emissions of hydrocarbons, $NO_x$, or CO or a combination thereof.

113. The method of claim 112, wherein the step of adjusting the ignition timing for at least a portion of the operating envelope of the internal combustion engine includes a step of adjusting the ignition timing for at least a portion of the operating envelope of the internal combustion engine such that the emissions of hydrocarbons, $NO_x$, or CO or a combination thereof are reduced.

114. The method of claim 111, wherein the step of adjusting the ignition timing includes a step of adjusting the ignition timing for at least a portion of the operating envelope of the internal combustion engine to control the torque output.

115. The method of claim 111, wherein the step of adjusting the ignition timing icnludes a step of adjusting the ignitiontiming for at least a portion of the operating envelope of the internal combustion engine to control the horsepower output.

116. The method of claim 111, wherein the step of adjusting the ignition timing includes a step of adjusting the ignition timing for at least a portion of the operating envelope of the internal combustion engine so as to increase combustion energy conversion efficiency of the internal combustion engine.

117. The method of any of claims 111–116, wherein the internal combustion engine is operated with air-to-fuel ratios that are leaner than stoichiometric.

* * * * *